US009051034B1

(12) United States Patent
Tarr

(10) Patent No.: US 9,051,034 B1
(45) Date of Patent: Jun. 9, 2015

(54) FRAME SYSTEM

(71) Applicant: Charles E. Tarr, Brooksville, ME (US)

(72) Inventor: Charles E. Tarr, Brooksville, ME (US)

( * ) Notice: Subject to any disclaimer, the term of this patent is extended or adjusted under 35 U.S.C. 154(b) by 0 days.

(21) Appl. No.: 14/445,218

(22) Filed: Jul. 29, 2014

(51) Int. Cl.
*F16B 7/04* (2006.01)
*B63B 59/00* (2006.01)
*F16C 11/04* (2006.01)

(52) U.S. Cl.
CPC ..... *B63B 59/00* (2013.01); *F16C 11/04* (2013.01)

(58) Field of Classification Search
USPC ..... 114/361; 403/169–176, 217, 218, 64, 403/70, 72, 79, 94, 96, 97
See application file for complete search history.

(56) References Cited

U.S. PATENT DOCUMENTS

| | | | | | |
|---|---|---|---|---|---|
| 3,424,178 | A | | 1/1969 | Yazaki | |
| 3,955,228 | A | * | 5/1976 | Gaschenko et al. | 114/361 |
| 4,274,222 | A | | 6/1981 | Zahn et al. | |
| 4,352,255 | A | | 10/1982 | Warehime | |
| 4,529,331 | A | * | 7/1985 | Schwartz | 403/73 |
| 4,582,016 | A | * | 4/1986 | Hansen | 114/361 |
| 4,593,641 | A | * | 6/1986 | Adams et al. | 114/343 |
| 4,926,782 | A | * | 5/1990 | Lacy | 114/361 |
| 4,940,009 | A | * | 7/1990 | Keithley, Jr. | 114/343 |
| 5,009,184 | A | * | 4/1991 | Voldrich | 114/361 |
| 5,697,320 | A | * | 12/1997 | Murray | 114/361 |
| 5,700,102 | A | | 12/1997 | Feleppa | |
| 5,904,114 | A | * | 5/1999 | Wright | 114/361 |
| 5,931,114 | A | * | 8/1999 | Bartholomew | 114/361 |
| 5,944,039 | A | * | 8/1999 | Bergeron | 135/119 |
| 6,006,692 | A | * | 12/1999 | Szukhent, Jr. | 114/361 |
| 6,260,505 | B1 | * | 7/2001 | Polidan | 114/361 |
| 6,892,503 | B1 | | 5/2005 | Kang | |
| 6,978,731 | B2 | * | 12/2005 | Erbetta | 114/361 |
| 7,472,666 | B1 | * | 1/2009 | Richard et al. | 114/361 |
| 7,484,472 | B1 | * | 2/2009 | Highfield | 114/361 |
| 7,950,342 | B2 | * | 5/2011 | Russikoff | 114/361 |
| 7,971,596 | B2 | * | 7/2011 | Morris et al. | 135/96 |
| 8,033,289 | B2 | * | 10/2011 | Buckley | 135/140 |
| 8,484,906 | B1 | * | 7/2013 | Tarr | 52/63 |
| 8,752,498 | B1 | * | 6/2014 | Schwindaman et al. | 114/361 |
| 2003/0005953 | A1 | * | 1/2003 | Erbetta et al. | 135/151 |
| 2006/0124045 | A1 | * | 6/2006 | Tucker et al. | 114/361 |
| 2008/0173228 | A1 | * | 7/2008 | Burroughs | 114/361 |
| 2009/0038528 | A1 | * | 2/2009 | Van Berkel | 114/361 |
| 2010/0083891 | A1 | * | 4/2010 | Russikoff | 114/361 |

* cited by examiner

*Primary Examiner* — Victor MacArthur
(74) *Attorney, Agent, or Firm* — Anthony D. Pellegrini

(57) ABSTRACT

A frame system suitable for use on a boat and capable of supporting one or more tarpaulins to protect the boat from the elements, comprising one or more sets of couplers and hinged angle elements adapted to be used with off-the-shelf connecting members, such as PVC pipes, such that when assembled the frame system provides a canopy frame arching over the top side of the boat, with the lateral sides of the frame system sloping upward and meeting over the longitudinal midline of the boat.

6 Claims, 10 Drawing Sheets

FRAME SYSTEM

BACKGROUND OF THE INVENTION

1. Technical Field

The present invention relates generally to frame systems. More particularly, the present invention relates to marine accessories such as a frame system for use on boats capable of supporting one or more tarpaulins to protect the boat when not in use. The frame system is also applicable to non-marine uses.

2. Description of Prior Art

Boats in general, and sailboats in particular, are typically removed from the water at the end of the boating season and stored on dry land. Many boats are stored outside, and thus are exposed to the weather. To prevent excess environmental exposure, boats may be covered by one or more tarpaulins, or they may be shrink-wrapped with a polyvinyl or other suitable material. Both methods have their deficiencies. Because the top sides of boats tend to have an irregular configuration extending upward from their decks, with various rails, stanchions, cockpits, seating areas, and in the case of sailboats, masts, spars, rigging, and the like, placing tarpaulins thereupon is difficult, with coverage often incomplete because of the irregularities. While shrink-wrapping boats tends to overcome some of the issues arising with the irregular top sides of boats, it creates its own problems. First, shrink-wrapping is substantially more expensive than using tarpaulins, and removal of a shrink-wrap cover to begin the boating season tends to destroy the cover, thus necessitating a new, expensive cover at the end of each season. Additionally, shrink-wrap covers limit the amount of airflow under the cover, which could increase the chance for the growth of mold and mildew. A shrink-wrap cover may also limit access to the boat under the cover. The use of tarpaulins is also compromised by the irregular topsides of the boat. In most instances, both in the use of tarpaulins and shrink-wrap, in an effort to compensate for this irregularity an ad hoc frame is constructed of lumber or other materials which are found at hand for this purpose. In most instances these frames do not provide a sufficiently uniform surface to adequately compensate for the irregular structure of the boat's topsides. Additionally, most of these frames are not reusable and may used for only a single season.

There is thus demonstrated the need for a frame system that may be reused for multiple seasons and that overcomes the difficulties associated with the irregularities of the upper decks of boats, while allowing for the use of relatively inexpensive, reusable, and breathable tarpaulins.

It is thus an object of the present invention to present a frame system capable of supporting one or more tarpaulins or shrink-wrap.

It is a further object of the present invention to present a frame system that can be easily assembled and disassembled.

It is yet a further object of the present invention to present a frame system that is easily customizable in size and configuration.

It is yet a further object of the present invention to present a frame system that is comprised of multiple standard components.

It is yet a further object of the present invention to present a frame system that is sturdy.

It is yet a further object of the present invention to present a frame system that is inexpensive to manufacture.

It is yet a further object of the present invention to present a frame system that is simple to use.

It is a further object of the present invention to present a frame system to be placed onto the deck of a boat.

It is yet a further object of the present invention to present a frame system to be placed onto the deck of a boat that is easily customizable to the size and configuration of the boat.

It is yet a further object of the present invention to present a frame system to be placed onto the deck of a boat that does not mar the deck surface.

Other objects of the present invention will be readily apparent from the description that follows.

SUMMARY OF THE INVENTION

The present invention discloses a frame system suitable for use on a marine vessel and capable of supporting one or more tarpaulins or shrink-wrap to protect the marine vessel from the elements. The frame system is also useful for non-marine applications, such as for supporting a canopy or a tent. The frame system comprises several standard components which can be coupled with readily available, inexpensive off-the-shelf connecting members. When assembled, the frame system provides a canopy frame arching over the top side of the boat, with lateral sides of the frame system sloping upward and meeting over the boat's longitudinal midline.

In its most basic form, the frame system comprises a five-arm coupler with one or more hinged connection elements. These hinged connection elements may be used at the front or rear of the five-arm coupler, and/or at the sides of the five-arm coupler, and/or at a distance from the five-arm coupler with rigid structural members interposed in between. Adding additional five-arm couplers and/or hinged connection elements gives the frame system greater flexibility of use. The five-arm couplers and the hinged connection elements are suitably adapted to be connected to each other by use of standard PVC pipes or other long, rigid, pole-like connecting members, such as wooden dowels or metal rods or pipes. In the preferred embodiments, each of the five-arm couplers and hinged connection elements has connection elements that are configured to internally receive the ends of standard PVC pipes or other connecting members (e.g., female ends adapted to receive the male ends of the connecting members). The lengths of the connecting members and the number of five-arm couplers and hinged connection elements dictate the ultimate configuration of the frame system. Longer lengths of lateral connecting members inserted into the five-arm couplers and hinged connection elements allow for a frame system to fit over a wider vessel; additional five-arm couplers and hinged connection elements may be added in series, front to rear, to accommodate longer vessels. By adjusting the angles of the hinged connection elements the frame can be configured either more or less steeply, or can be adjusted to span over obstructions or other irregular structures.

In alternate embodiments, the five-arm couplers and hinged connection elements project connection stubs which are adapted to fit into the end openings of PVC pipes (e.g., male ends adapted to fit into the female ends of the connecting members). In yet other embodiments, the five-arm couplers and hinged connection elements may comprise a mix of male and female ends, as described above. In yet other embodiments, the connection elements of the five-arm couplers and hinged connection elements may be threaded, and accommodate threaded connecting members. The threads may be internal to the connection elements, to accommodate externally threaded connecting members, or the threads may be external to the connection elements, to accommodate internally threaded connecting members, or a mix of internally and externally threaded connecting members. Threaded adapters may be used with standard non-threaded connecting members.

In all embodiments, the bottom ends of the base members of the frame system may be finished with protective caps to prevent marring of the deck or bright work.

It is to be understood that the foregoing and following description of the invention is intended to be illustrative and exemplary rather than restrictive of the invention as claimed. These and other aspects, advantages, and features of the invention will become apparent to those skilled in the art after review of the entire specification, accompanying figures, and claims incorporated herein.

DETAILED DESCRIPTION OF THE INVENTION

Figure 1A:
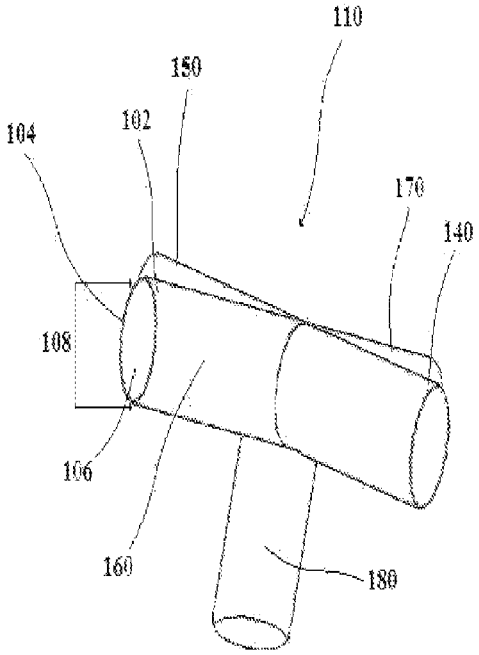
FIG. 1A is a perspective side view of the five-arm coupler of the present invention.
Figure 1B:
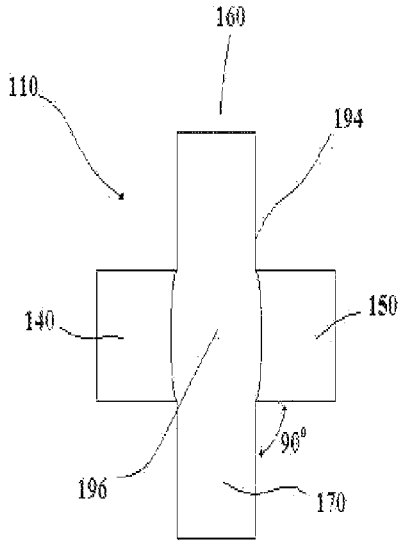
FIG. 1B is a top view of the five-arm coupler depicted in FIG. 1A.
Figure 1C:
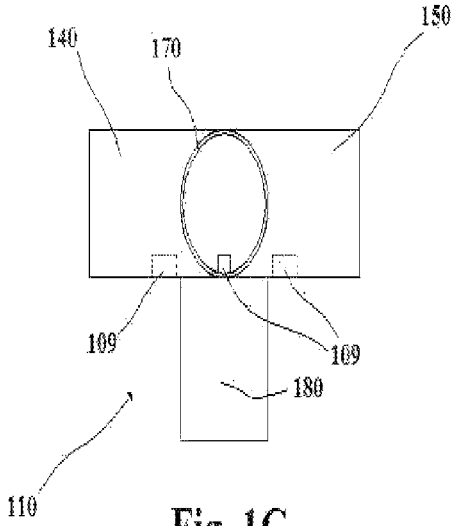
FIG. 1C is a rear view of the five-arm coupler depicted in FIG. 1A. They optional key element is shown in ghost lines.

The five-arm coupler 110 of the frame system 1 comprises five fixed connection elements, with four fixed connection elements being substantially coplanar and oriented substantially horizontally, forming a cross, and the fifth fixed connection element extending downward and oriented substantially perpendicular to the other fixed connection elements. See FIGS. 1A, 1B, and 1C. The fixed connection elements are rigid and fixedly attached to each other such that their relative orientations to each other remain constant. Alternatively, the five-arm coupler 110 may be formed of a single piece of material, such as injection molded plastic. Any suitable material may be used for the five-arm coupler 110.

The front fixed connection element 160 of the five-arm coupler 110 is oriented substantially collinear with the rear fixed connection element 170. Together, the front and rear fixed connection elements 160,170 form a substantially cylindrical cross member 194 having openings at opposite ends. The cross member 194 is oriented substantially horizontally. The left fixed connection element 140 of the five-arm coupler 110 is located at a midsection 196 of the cross member 194 formed by the front and rear fixed connection elements 160, 170 and is oriented substantially perpendicular to the cross member 194. The right fixed connection element 150 is located opposite the cross member 194 from the left fixed connection element 140 and is oriented substantially perpendicular to the cross member 194. The front fixed connection element 160, the rear fixed connection element 170, the left fixed connection element 140, and the right fixed connection element 150 are substantially coplanar with each other. The vertical fixed connection element 180 is located at the midsection 196 of the cross member 194 between the left and right fixed connection elements 140,150 and oriented substantially perpendicular to the plane of the other four connection members 140,150,160,170. Each of the fixed connection elements 140,150,160,170,180 of the five-arm coupler 110 is substantially elongate and substantially cylindrical. In the preferred embodiment each fixed connection element has an outer end 102 and a hollow interior 104, an opening 106 through the outer end 102 allowing access into the interior 104, and a substantially uniform inside diameter 108. In the preferred configuration, each fixed connection element has substantially the same inside diameter 108 as each other fixed connection element.

The five-arm coupler 110 is adapted to be used with one or more hinged connection elements 600, which may be a left connection hinge element 610, a right connection hinge element 620, a front connection hinge element 630, and a rear connection hinge element 640. Each of the hinged connection elements 600 has a proximate end 602 and a distal end 604 and a hinge mechanism 606 interposed between the proximate and distal ends 602,604 such that the proximate and distal ends 602, 604 may be varyingly angled in relation to each other. That is, each hinged connection element may be positioned such that it forms any desired angle. The hinge mechanism 606 is adapted to allow the proximate and distal ends 602,604 to be moved in relation to each other, and then to be placed in fixed relation to each other once the desired angle is obtained.

Figure 2A:
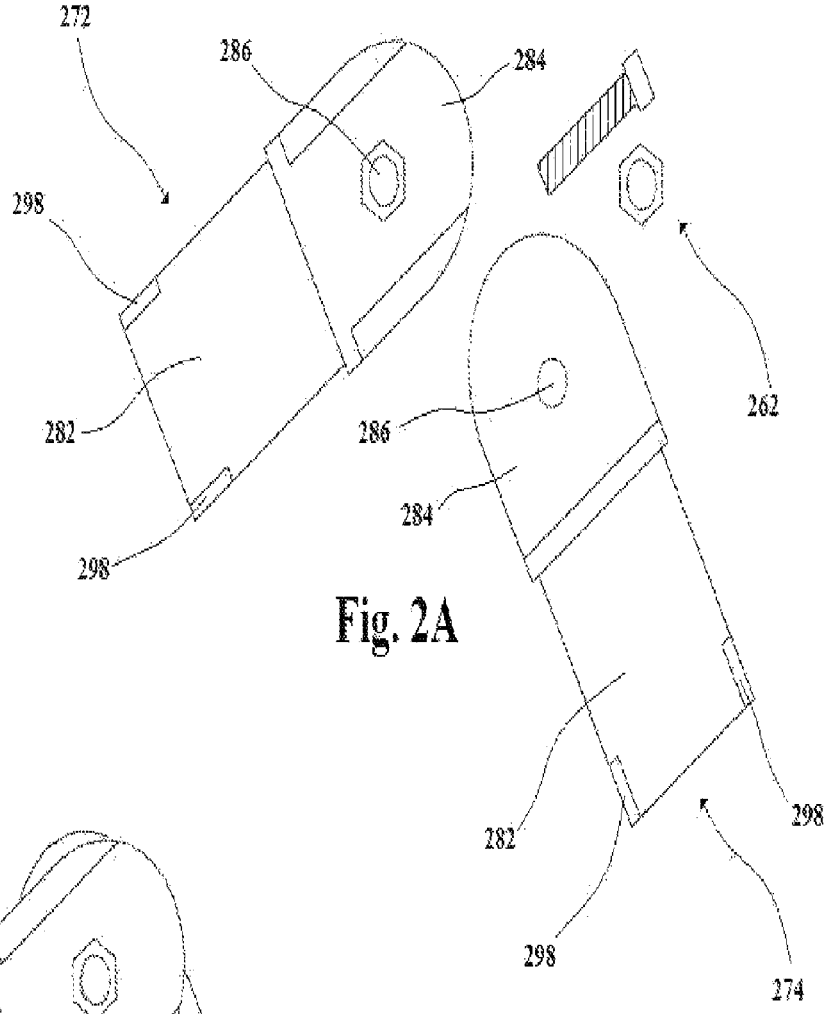
FIG. 2A is an exploded side view of the hinge connection element of the present invention.
Figure 2B:
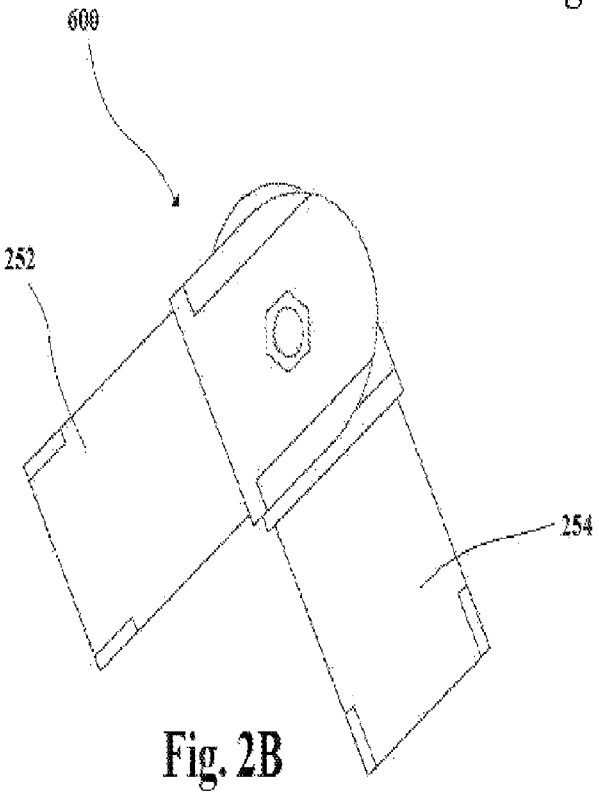
FIG. 2B is a side view of an assembled hinge connection element depicted in FIG. 2A.

In one embodiment, each of the hinged connection elements 600 comprises a first body 272 and a second body 274. The first body 272 has a substantially cylindrical shaft 282 and a substantially planar flange 284 extending from one end of the shaft 282. The other (distal) end 292 of the shaft 282 has an opening 296. The flange 284 is oriented substantially parallel to the longitudinal axis of the shaft 282, and has a central aperture 286 passing through it. The second body 274 is sized and configured substantially the same as the first body 272. See FIG. 2A. The flange 284 of the first body 272 is placed against the flange 284 of the second body 274 such that their respective central apertures 286 are aligned. Then a fastener 262 is placed through both central apertures 286, securing the first and second bodies 272,274 to each other. See FIG. 2B. The fastener 262 may be any suitable device, such as a nut and bolt combination. The combination of the flanges 284 and the fastener 262 constitute the hinge mechanism 606 of the hinged connection elements 600. The facing surfaces of the flanges 284 of the first and second bodies 272,274 may be textured to provide increased frictional adherence. Alternately, they may be formed with corresponding radial grooves such that the flanges 284 set against each other in defined orientations. In this configuration, the grooves may be calibrated to provide fixed angular increments, such as every five degrees, so that the angle between the proximate end 602 and the distal end 604 of the hinged connection element 600 can be set precisely. Other configurations, such as pins and holes corresponding to fixed angular orientations, may also be used.

Figure 3:
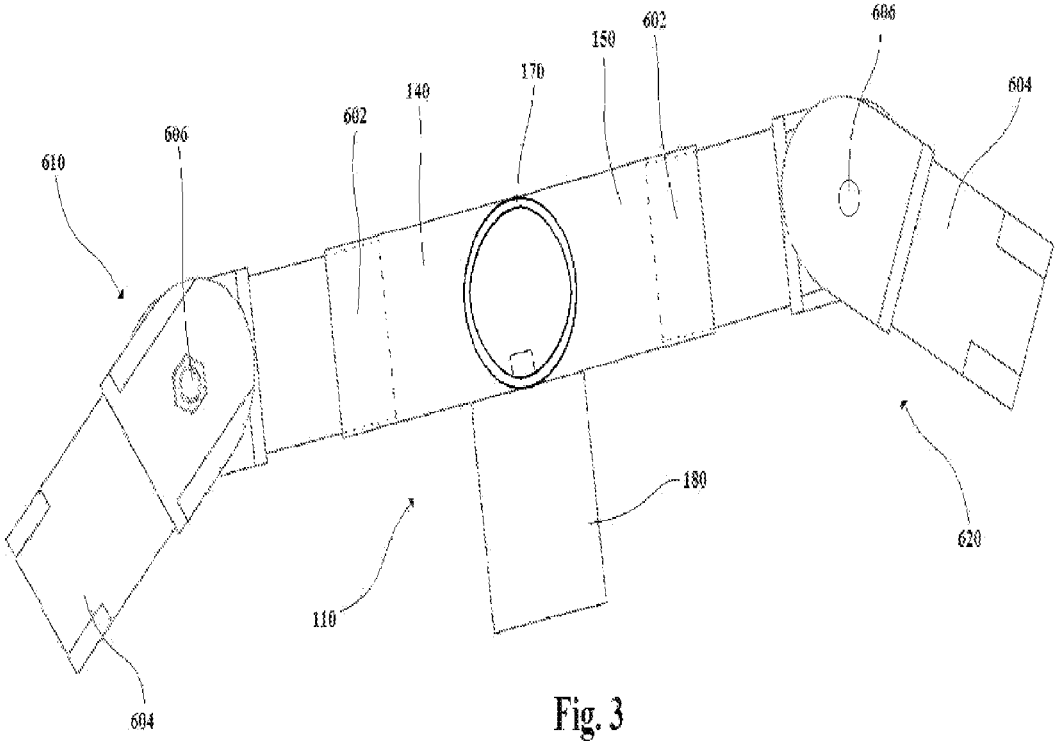
FIG. 3 is a side view of a five-arm coupler with a hinge connection element attached to the left fixed connection element of the five-arm coupler and a hinge connection element attached to the right fixed connection element of the five-arm coupler.
Figure 4A:
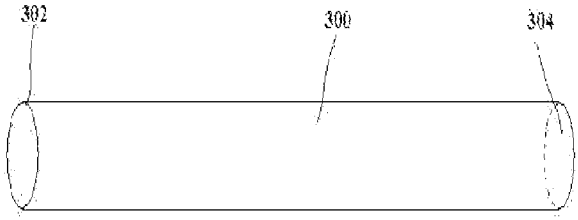
FIG. 4A is a perspective side view of one embodiment of a connecting member that may be used with the present invention.
Figure 4B:
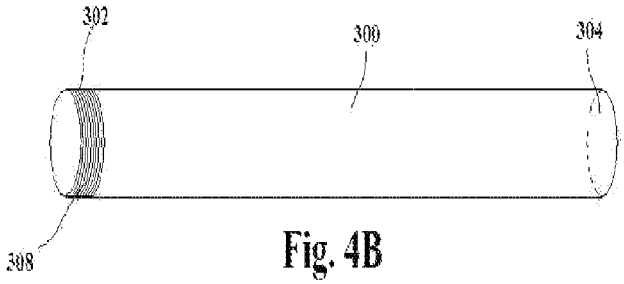
FIG. 4B is a perspective side view of an alternative embodiment of a connecting member that may be used with the present invention, whereby the connecting member has outside threads which may be inserted into the threaded end of a fixed connection element of a five-arm coupler or hinge connection element.
Figure 4C:
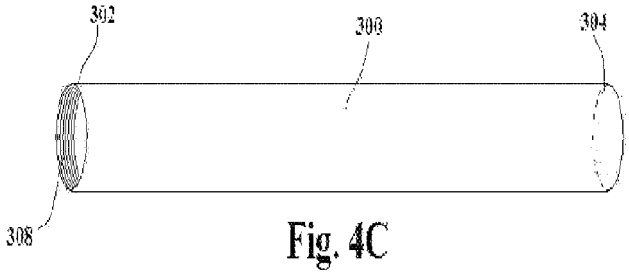
FIG. 4C is a perspective side view of another alternative embodiment of a connecting member that may be used with the present invention, whereby the connecting member has inside threads which may be placed over the threaded end of a fixed connection element of a five-arm coupler or hinge connection element.
Figure 4D:
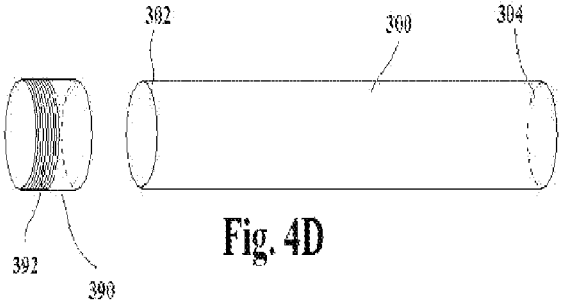
FIG. 4D is a perspective side view of yet another alternative embodiment of a connecting member that may be used with the present invention, whereby a threaded adapter is used with the connecting member such that, once the adapter is affixed to the connecting member, the outside threads of the adapter may be inserted into the threaded end of a fixed connection element of a five-arm coupler or hinge connection element.

The hinged connection elements 600 may be used with the five-arm coupler 110 as follows: the proximate end 602 of the front connection hinge element 630 may be connected with the outer end 102 of the front fixed connection element 160 of the five-arm coupler 110, the proximate end 602 of the rear connection hinge element 640 may be connected with the outer end 102 of the rear fixed connection element 170 of the five-arm coupler 110, the proximate end 602 of the left connection hinge element 610 may be connected with the outer end 102 of the left fixed connection element 140 of the five-arm coupler 110, and the proximate end 602 of the right connection hinge element 620 may be connected with the outer end 102 of the right fixed connection element 150 of the five-arm coupler 110. See FIG. 3. However, it is not required that each of these hinged connection elements 600 be connected to the five-arm coupler 110, and in practice it is contemplated that fewer than four, and possibly no, hinged connection elements 600 will be connected to the five-arm coupler 110. The connection between the fixed connection elements and the hinged connection elements 600 may be friction fitted, whereby the proximate end 602 of each hinged connection elements 600 is fitted over the outer end 102 of the corresponding fixed connection element, or alternatively the proximate end 602 of each hinged connection element 600 is fitted into the outer end 102 of the corresponding fixed connection element. In one variation of this configuration, the fixed connection element has a raised projection—a key 109—extending into its hollow interior 104 and the hinged connection element 600 has a pair of slots 298 formed into the shafts 282 of its first and second bodies 272,274. Each of the slots 298 align with the key 109 to ensure that the hinged connection element 600 is oriented orthogonally to the fixed connection element when inserted therein. The key 109 is located back in the interior of the connection element, distant from the opening. In another embodiment, the proximate end 602 of each hinged connection element 600 is threaded onto the outer end 102 of the corresponding fixed connection element, or alternatively the proximate end 602 of each hinged connection element 600 is threaded into the outer end 102 of the corresponding fixed connection element. In yet another embodiment, adhesives may be used to secure the hinged connection elements 600 to the fixed connection elements, or mechanical fasteners, or any other suitable means.

The five-arm coupler 110 together with the hinged connection elements 600 is further adapted to be used with connecting members 300, each of which is an elongate, substantially rigid rod or pole. See FIGS. 4A, 4B, 4C, and 4D. Each connecting member 300 has an end 302 that is adapted to be attached to the distal end 604 of a hinged connection element 600. Connecting members 300 are preferably lengths of PVC pipe. PVC pipe can be readily obtained from common suppliers and cut to the exact length needed to create a custom fitted frame system 1. However, other materials may also be appropriate for connecting members 300, such as wooden dowels or metal rods or pipes.

The distal end 604 of the left connection hinge element 610 may be connected with the first end 302 of an elongate left connecting member 312. The distal end 604 of the right connection hinge element 620 may be connected with the first end 302 of an elongate right connecting member 314. The distal end 604 of the front connection hinge element 630 may be connected with the first end 302 of an elongate front connecting member 340. The distal end 604 of the rear connection hinge element 640 may be connected with the first end 302 of an elongate rear connecting member 350. However, it is not required that each of these hinged connection elements 600 be used to connect the five-arm coupler 110 to the elongate connecting members 300, and in practice it is contemplated that fewer than four, and possibly no, hinged connection elements 600 will be used to connect the five-arm coupler 110 to the elongate connecting members 300. The outer end 102 of the vertical fixed connection element 180 is in connection with the first end 254 of an elongate vertical connecting member 316. So configured, the elongate front and rear connecting members 340,350 may be positioned at any angle relative to each other by setting the angles of the front connection hinge element 630 and the rear connection hinge element 640 as desired. Similarly, the elongate left and right connecting members 312,314 may be positioned at any angle relative to each other by setting the angles of the left connection hinge element 610 and the right connection hinge element 620 as desired. The elongate vertical connecting member 316, however, is always oriented perpendicular to the plane of the left, right, front, and rear fixed connection elements 140,150,160,170 of the five-arm coupler 100.

The connections between the elongate connecting members 312,314,340,350 and the hinged connection elements 600 are similar to the connections between the hinged connection elements 600 and the fixed connection elements 140, 150,160,170 of the five-arm coupler 110. That is, an end 302 of a connecting member 300 may be inserted into the interior 294 of the shaft 282 of the hinged connection element 600, and secured thereto. Alternatively, an end 302 of a connecting member 300 may be inserted over the distal end 292 of the shaft 282 of the hinged connection element 600, and secured thereto. The connecting member 300 may be secured to the hinged connection element 600 by mechanical fasteners, such as screws, bolts, clips, or the like, or by the use of adhesives, or simply by friction fittings. Where the frame system 1 is intended to be disassembled when not in use, mechanical fasteners or friction fittings are used. Alternatively, a combination of mechanical fasteners, adhesives, and/or friction fittings may be used.

Figure 5:
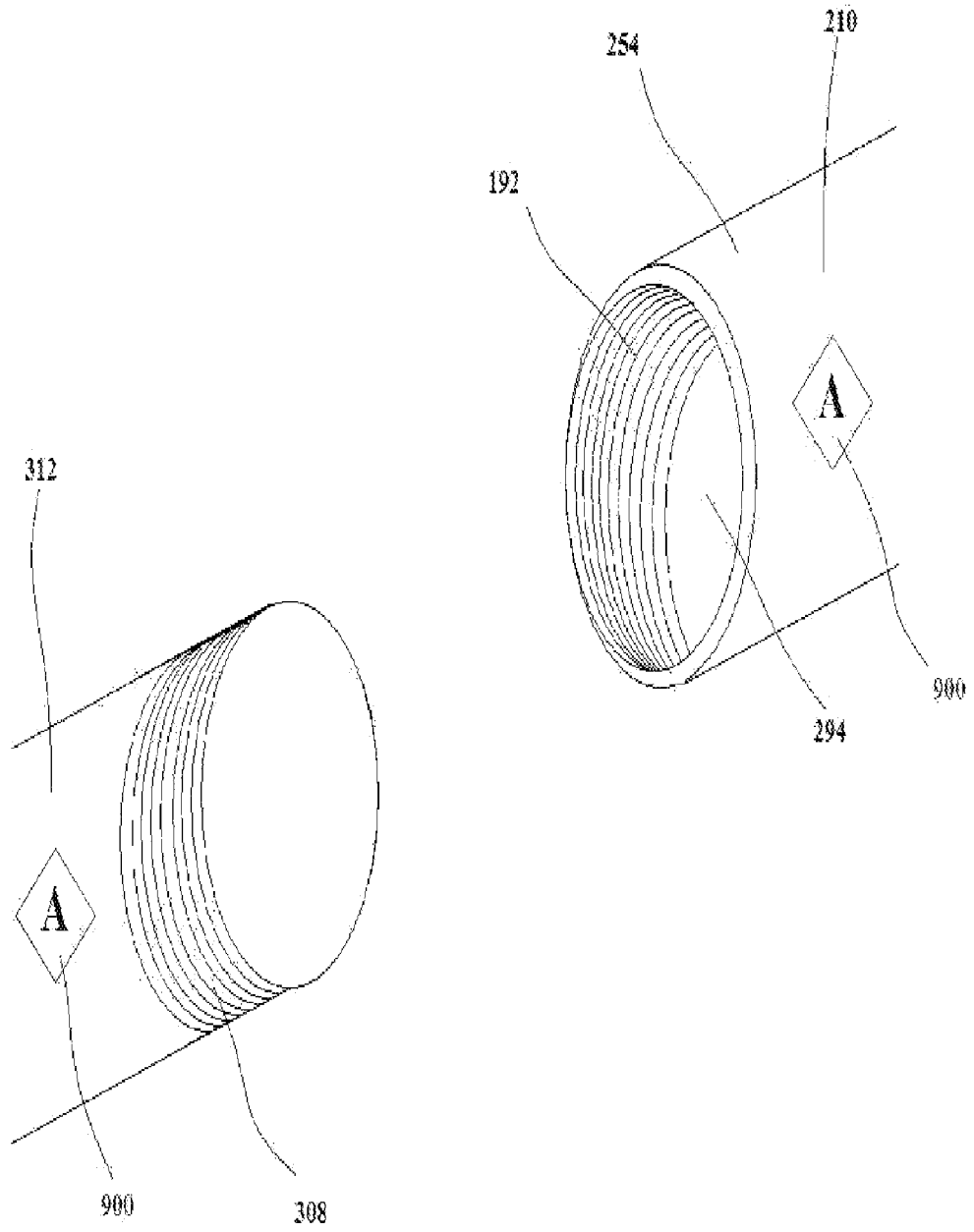
FIG. 5 is a perspective view of the of the connection interface between a hinge connection element and a connecting member, whereby the configuration having a fixed connection element with inside threads and a connecting member with outside threads is shown.
Figure 6:
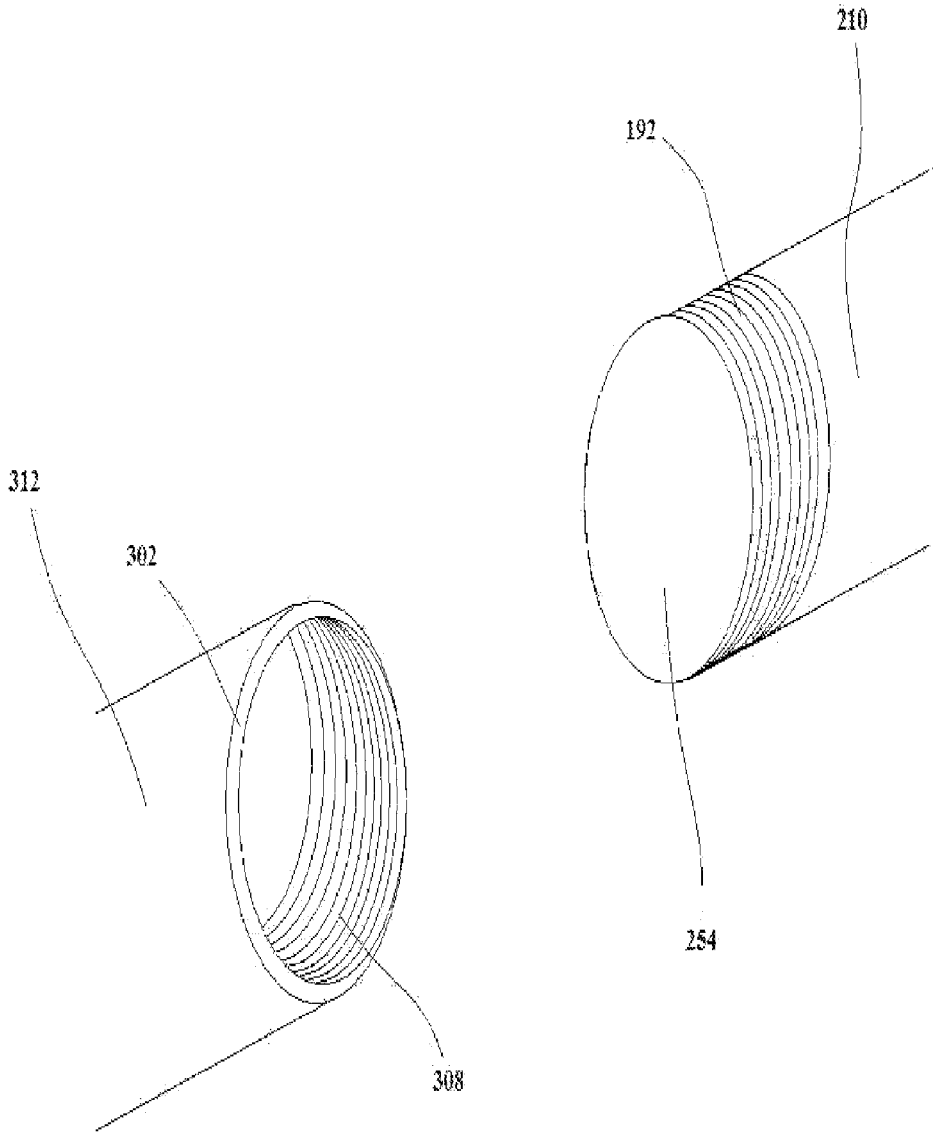
FIG. 6 is a perspective view of the of the connection interface between a hinge connection element and a connecting member, whereby the configuration having a fixed connection element with outside threads and a connecting member with inside threads is shown.

In another alternative embodiment the ends of the connecting members 300 are threaded, as are the distal ends 292 of the shafts 282 of the hinged connection elements 600. In one configuration the inside of each hinged connection element 600 has threads 192, and the ends 302,304 of the connecting members 300 have matching outer threads 308. See FIGS. 4B and 5. The connecting members 300 are attached to the hinged connection elements 600 by threading the ends 302, 304 of the connecting members 300 into the openings 296 of the shafts 282 of the hinged connection elements 600. In another configuration the outside of the distal end 604 of each hinged connection element 600 is threaded, and the ends 302,304 of the connecting members 300 have matching inner threads 308. See FIGS. 4C and 6. The connecting members 300 are attached to the hinged connection elements 600 by threading the ends 302,304 of the connecting members 300 onto the distal ends 292 of the shafts 282 of the hinged connection elements 600. In either configuration, an adapter 390 may be used to create the threads 392 on the ends 302,304 of the connecting members 300. See FIG. 4D. The adapter 390 may be permanently or temporarily affixed to the end 302 of the connecting member 300 using any of the means discussed herein. The placement of the threads 192 on the hinged connection elements 600 and threads 392 on the ends 302,304 of the connecting members 300 may be mixed between internal and external threads, as desired. In all of these configurations, the threaded hinged connection elements 600 and connecting members 300 allow frame system 1 to be easily assembled and disassembled.

Figure 7:
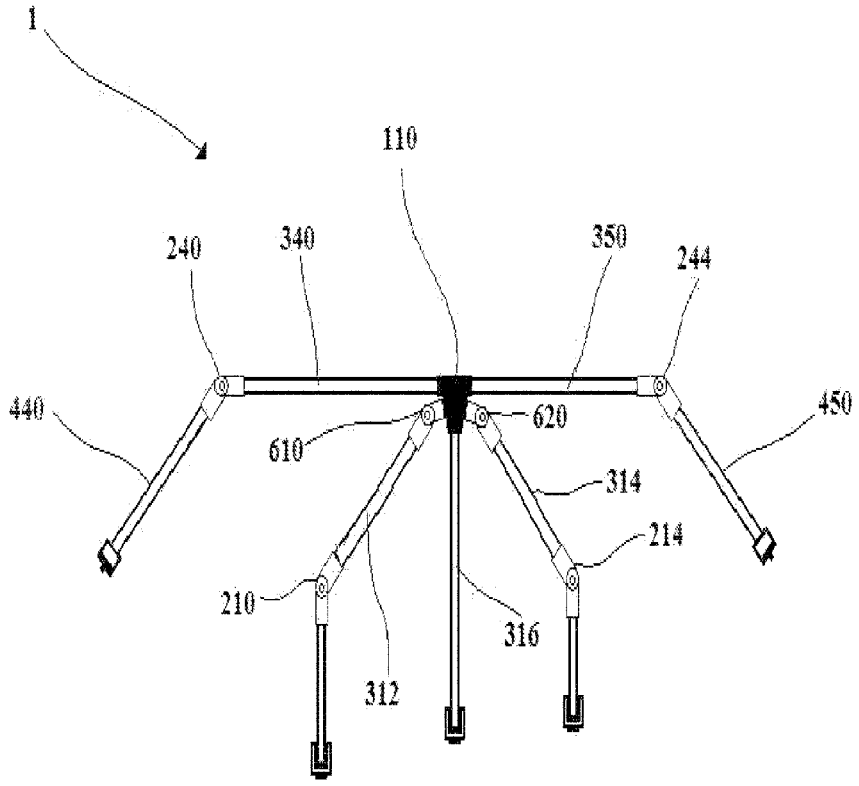
FIG. 7 is a schematic view of the of the frame system of the present invention having one five-arm coupler.
Figure 8:
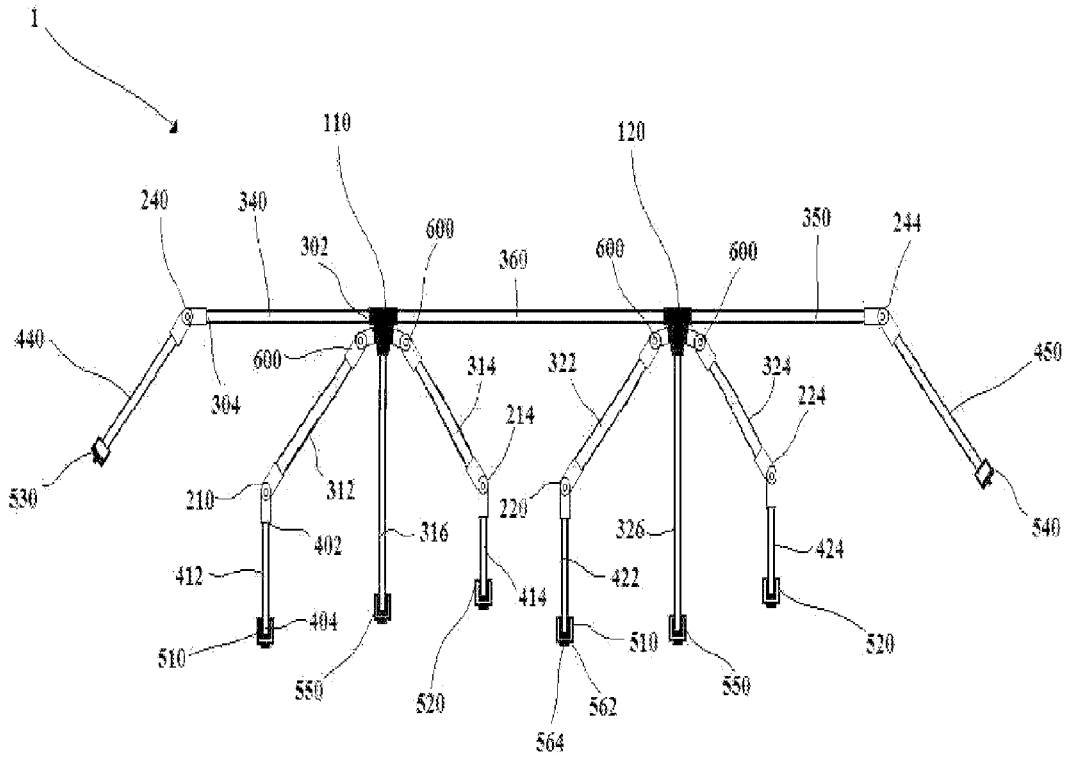
FIG. 8 is a schematic view of the of the frame system of the present invention having two five-arm couplers.
Figure 9:
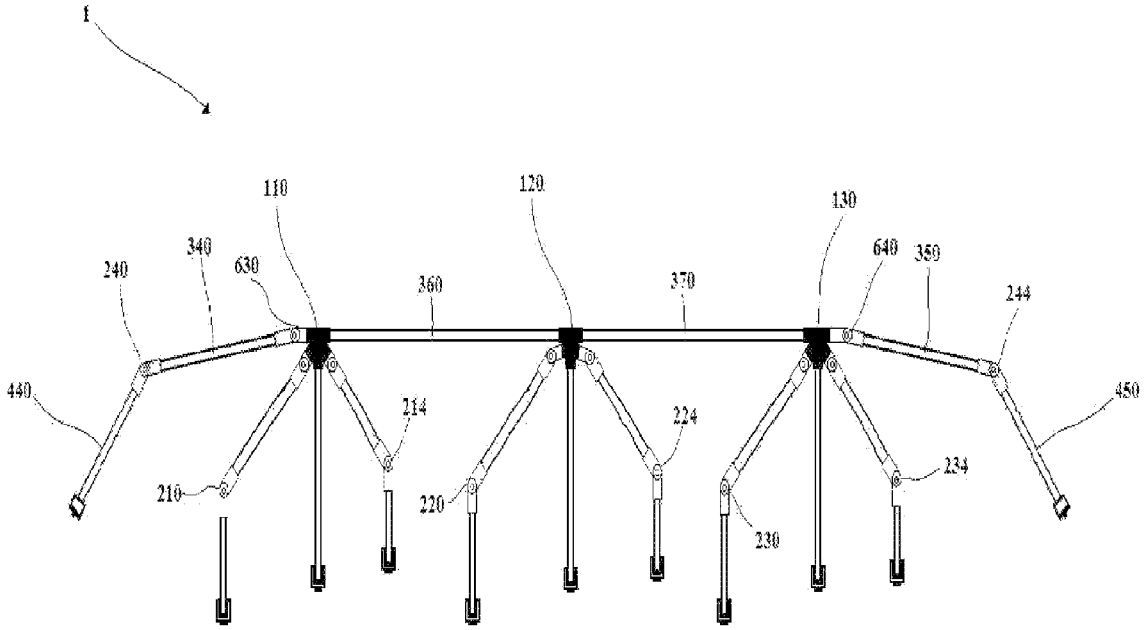
FIG. 9 is a schematic view of the of the frame system of the present invention having three five-arm couplers.

The frame system 1 may also include additional hinged connection elements 600 designated a first left angle hinge element 210, a first right angle hinge element 214, a front angle hinge element 240, and a rear angle hinge element 244. See FIGS. 7, 8, and 9. Each of the angle hinge elements of the frame system 1 is sized and configured identically to the other hinged connection elements 600. That is, all hinged connection elements 600, including angle hinge elements, may be used interchangeably. The use of angle hinge elements allows further flexibility in configuring the frame system 1.

The angle hinge elements 210,214,240,244 of the frame system 1 are connected to the five-arm coupler 110 as follows: an elongate left connecting member 312 is interposed between the left fixed connection element 140 and the first left angle hinge element 210 and attached at one end to the left fixed connection element 140 and at the other end to the proximate end 252 of the first left angle hinge element 210; an elongate right connecting member 314 is interposed between the right fixed connection element 150 and the first right angle hinge element 214 and attached at one end to the right fixed connection element 150 and at the other end to the proximate end 252 of the first right angle hinge element 214; an elongate front connecting member 340 is interposed between the front fixed connection element 160 and the front angle hinge element 240 and attached at one end to the front fixed connection element 160 and at the other end to the proximate end 252 of the front angle hinge element 240; and an elongate rear connecting member 350 is interposed between the rear fixed connection element 170 and the rear angle hinge element 244 and attached at one end to the rear fixed connection element 170 and at the other end to the proximate end 252 of the rear angle hinge element 244. In addition, an elongate vertical connecting member 316 is attached to the vertical fixed connection element 180 of the five-arm coupler 110. See FIG. 7. Alternatively, one or more of the hinged connection elements 600 may be interposed between the connecting members 300 and the fixed connection elements 140,150,160,170 of the five-arm coupler 110.

Figure 10:
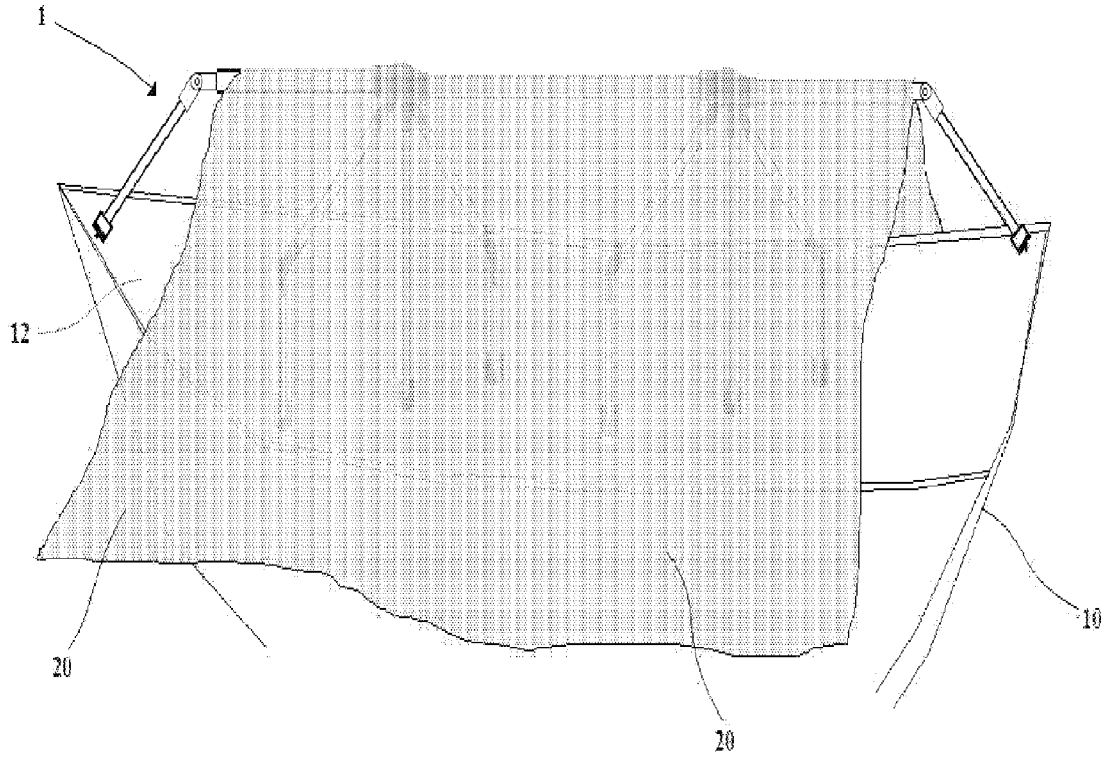
FIG. 10 is a schematic view of the of the frame system of the present invention having two five-arm couplers, placed onto the deck of a boat, with a tarpaulin placed over the frame system (elements behind the tarpaulin are showed grayed out).

Each angle hinge element further may be connected to a base member. A base member is essentially the same item as a connecting member 300, having a first (proximate) end 402 and a second (distal) end 404, cut down to an appropriate length. The base members are connected to the angle hinge elements as follows: a left base member 412 is attached to the distal end 254 of the first left angle hinge element 210; a right base member 414 is attached to the distal end 254 of the first right angle hinge element 214; a front base member 440 is attached to the distal end 254 of the front angle hinge element 240; and a rear base member 450 is attached to the distal end 254 of the rear angle hinge element 244. The base members are attached to the angle hinge elements in the same manner as the connecting members 300 are attached to the angle hinge elements. So configured, with couplers 110, hinged connection elements 600, and connecting members 300, the frame system 1 may be placed on the deck 12 of a boat 10 and one or more tarpaulins 20 may be placed over the frame system 1. See FIG. 10.

The frame system 1 may further comprise a set of end caps to be placed onto the distal ends 404 of the base members. These include a left end cap 510, a right end cap 520, a center end cap 550, a front end cap 530, and a rear end cap 540. See FIG. 8. The end caps are adapted to provide a protective interface between the base members of the frame system 1 and the portions of the boat 10 onto which the frame system 1 is placed. In one embodiment the end caps have a cup-like configuration into which the distal ends 404 of the base members are placed. In other embodiments the end caps fit into the distal ends 404 of the base members. In such embodiments the end cap has an inverted mushroom configuration whereby the stem (male fitting) is inserted into an opening at the distal end (female fitting) 404 of the base member. In these embodiments the end caps are secured to the distal ends 404 of the base members with mechanical fasteners, adhesives, or friction fittings, as described above. In yet another embodiment the end caps may be threaded, as described above, and are attached to the base members by being threaded onto the threaded distal ends 404 of the base members. In yet another embodiment whereby the end caps have an inverted mushroom configuration, as described above, the stem may have external threads and may be threaded into the internally threaded distal ends 404 of the base members. A mix of internally threaded and externally threaded end caps is also contemplated.

In the preferred embodiments the end caps have a bottom side located opposite the attachment point between the base member and the end cap. The bottom side of the end cap has attached to it a cushioning substance to protect the surface of the boat 10. The cushioning substance may be made of rubber, felt, or any other malleable material. In one configuration the cushioning substance may be a cushioned pad covering substantially all of the bottom side of the end cap. In another embodiment it may be a standard crutch tip, fitted over a projection extending from the bottom side of the end cap. In yet another embodiment the end cap may comprise a cushioned circumferential ring. In yet another embodiment there may be a plurality of small cushioned pads attached to the bottom side of the end cap. There may further be a central aperture passing through the bottom side of the end cap so that the base member to which the end cap is fitted can be placed over a stanchion or other items projecting upwards from the boat 10.

In alternative embodiments where the frame system 1 is intended to be used as a ground-based canopy or tent, rather than on a boat 10, the set of end caps that is placed onto the distal ends 404 of the base members may be fitted with one or more downward oriented spikes on their bottom sides. These spikes are intended to be inserted into the ground and serve to secure the base members to the ground.

Where a larger frame system 1 is required, the frame system 1 may further comprise a second five-arm coupler 120 and a second pair of left and right angle hinge elements 220,224. See FIG. 8. The second five-arm coupler 120 may be configured substantially the same as the first five-arm coupler 110 as described above, in all of its variations. Similarly, the second left angle hinge element 220 may be configured substantially the same as the first left angle hinge element 210 as described above, and the second right angle hinge element 224 may be configured substantially the same as the first right angle hinge element 214 as described above. These additional components will have associated with them an elongate second left connecting member 322, an elongate second right connecting member 324, and an elongate second vertical connecting member 326, as well as a second left base member 422 and a second right base member 424. To connect the second five-arm coupler 120 to the first five-arm coupler 110, an elongate intermediate connecting member 360, configured substantially the same as the other connecting members 300 as described above, is interposed between the two five-arm couplers 110,120 and attached at one end to the rear fixed connection element 170 of the first five-arm coupler 110 and attached at its other end to the front fixed connection element 160 of the second five-arm coupler 120. The elongate rear connecting member 350 may be connected to the rear connection hinge element 640 of the second five-arm coupler 120 or may be connected directly to the rear fixed connection element 170 of the second five-arm coupler 120.

Where even larger frame systems 1 are required, one or more additional five-arm couplers 130 may be added in series after the first and second five-arm couplers 110,120, each additional five-arm coupler configured as described above, together with associated left and right angle hinge elements 230,234, left, right, and vertical fixed connection elements 332,334,336, and left and right base members 432,434. See FIG. 9. To connect the additional five-arm couplers 130 to the first and second five-arm couplers 110,120, additional elongate intermediate connecting members 360,370, configured substantially the same as the other connecting members 300 as described above, are interposed between the five-arm couplers 110,120,130 and attached thereto. Thus, for example, a completed frame system 1 may have four five-arm couplers, each with an associated left and right angle element, joined together by three intermediate connecting members, with the front-most (first) five-arm coupler 110 having the elongate front connecting member 340 attached to its front fixed connection element 160 and the rear-most (fourth) five-arm coupler having the elongate rear connecting member 350 attached to its rear fixed connection element. Where multiple five-arm couplers are used, the associated elongate connecting members and base members may be of different length. This allows for customization of the frame system 1. For example, if the boat 10 has a closed forward deck 12 but an open rear cockpit, the left and right base members 412,414 and elongate vertical connecting member 316 associated with the forward five-arm coupler 110 may be of shorter length than the left and right base members 422,424 and elongate vertical connecting member 326 associated with the rearward five-arm coupler 120. Similarly, where there is structure located on one side of the boat 10 but not on the other, the associated elongate left and right connecting and base members may be of different lengths.

In yet another embodiment, the frame system 1 further comprises a plurality of stickers 900. See FIG. 5. The stickers 900 are suitable for being affixed to the ends of the fixed connection elements of the five-arm couplers, the ends of the left and right connection hinge elements, the ends of the front and rear connection hinge elements, the ends of the left and right angle hinge elements, the ends of the front and rear angle hinge elements, and the ends of the connecting members. Pairs of stickers 900 are visually complementary, such that each of a complementary pair can be affixed to the ends of connecting components. Thus, after disassembly, the frame system 1 can be reassembled by aligning the complementary pairs of stickers 900, to help keep track of which components fit together with which others. The complementary identifications of the pairs of stickers 900 can be by color, or shape, or text, or a combination of same. For example, the stickers 900 to be placed on the port (left) side of the frame system 1 might be green, the stickers 900 to be placed on the starboard (right) side of the frame system 1 might be red, and the stickers 900 to be placed on the center components might be yellow, with each pair numbered "1-1", "2-2", etc., for each color scheme. Other complementary identifications are also contemplated.

Modifications and variations can be made to the disclosed embodiments of the present invention without departing from the subject or spirit of the invention as defined in the following claims.

I claim:

1. A frame system comprising a first five-arm coupler and one or more hinged connection elements, said first five-arm coupler having a left fixed connection element, a right fixed connection element, a front fixed connection element, a rear fixed connection element, a vertical fixed connection element, with each of the fixed connection elements of the first five-arm coupler being substantially elongate and substantially cylindrical and having an outer end and a hollow interior, an opening through the outer end allowing access into the interior, an inner surface facing the interior, and a substantially uniform inside diameter, with the front fixed connection element of the first five-arm coupler is fixedly attached to and oriented substantially collinear with the rear fixed connection element of the first five-arm coupler, forming a substantially cylindrical cross member having openings at opposite ends, the left fixed connection element of the first five-arm coupler is fixedly attached to a midsection of the cross member of the first five-arm coupler and oriented substantially perpendicular to the cross member of the first five-arm coupler, the right fixed connection element of the first five-arm coupler is fixedly attached to the midsection of the cross member of the first five-arm coupler opposite the left fixed connection element of the first five-arm coupler and oriented substantially perpendicular to the cross member of the first five-arm coupler and substantially collinear with the left fixed connection element of the first five-arm coupler, and the vertical fixed connection element of the first five-arm coupler is fixedly attached to the midsection of the cross member of the first five-arm coupler between the left fixed connection element of the first five-arm coupler and the right fixed connection element of the first five-arm coupler and oriented substantially perpendicular to the plane of the cross member of the first five-arm coupler; and with each of the one or more hinged connection elements having a proximate end and a distal end and a hinge mechanism interposed between the proximate and distal ends such that the proximate and distal ends may be varyingly angled in relation to each other;

wherein the outer end of the front fixed connection element of the first five-arm coupler is in connection with a first end of an elongate front connecting member, the outer end of the rear fixed connection element of the first five-arm coupler is in connection with a first end of an elongate rear connecting member, the outer end of the left fixed connection element of the first five-arm coupler is in connection with a first end of an elongate first left connecting member, the outer end of the right fixed connection element of the first five-arm coupler is in connection with a first end of an elongate first right connecting member, the outer end of the vertical fixed connection element of the first five-arm coupler is in connection with a first end of an elongate first vertical connecting member, and at least one of the one or more hinged connection elements is interposed between one of the front, rear, left, or right fixed connection elements of the first five-arm coupler and an elongate connecting member, with the proximate end of said hinged connection element being in connection with the outer end of said fixed connection element of said five-arm coupler and the distal end of said hinged connection element being in connection with the first end of said elongate connecting member;

wherein each of the one or more hinged connection elements comprises a first body and a second body, with the first body having a substantially cylindrical shaft and a substantially planar flange extending from an end of said shaft, said flange oriented substantially parallel to a longitudinal axis of said shaft, with said flange having a central aperture, and the second body being sized and configured substantially identically to the first body, with the hinge mechanism of each of the hinged connection elements being a fastener suitably adapted to pass through the central apertures of the flanges of the first and second bodies of each of the hinged connection elements and to hold said first and second bodies in fixed relation to each other once the proximate and distal ends of each of the hinged connection elements have been positioned relative to each other at a desired angle; and wherein one or more of the fixed connection elements of the first five-arm coupler has a single raised projection extending from its inner surface into its hollow interior, such raised projection being substantially rectangular in profile and located set back from the opening of the associated fixed connection element, each of such one or more fixed connection elements being designated a keyed connection element, and the shafts of the first and second bodies of each hinged connection element have a pair of slots formed thereon, whereby each of said slots are capable of being aligned with each raised projection in order to cause the hinged connection elements to remain in a predetermined orientation relative to said one or more keyed connection elements when connected thereto.

2. The frame system of claim 1 wherein the fastener of each hinged connection element is a mated bolt and nut pair.

3. A frame system comprising a first five-arm coupler, a second five-arm coupler, and one or more hinged connection elements, said first five-arm coupler having a left fixed connection element, a right fixed connection element, a front fixed connection element, a rear fixed connection element, a vertical fixed connection element, with each of the fixed connection elements of the first five-arm coupler being substantially elongate and substantially cylindrical and having an outer end and a hollow interior, an opening through the outer end allowing access into the interior, an inner surface facing the interior, and a substantially uniform inside diameter, with the front fixed connection element of the first five-arm coupler is fixedly attached to and oriented substantially collinear with the rear fixed connection element of the first five-arm coupler, forming a substantially cylindrical cross member having openings at opposite ends, the left fixed connection element of the first five-arm coupler is fixedly attached to a midsection of the cross member of the first five-arm coupler and oriented substantially perpendicular to the cross member of the first five-arm coupler, the right fixed connection element of the first five-arm coupler is fixedly attached to the midsection of the cross member of the first five-arm coupler opposite the left fixed connection element of the first five-arm coupler and oriented substantially perpendicular to the cross member of the first five-arm coupler and substantially collinear with the left fixed connection element of the first five-arm coupler, and the vertical fixed connection element of the first five-arm coupler is fixedly attached to the midsection of the cross member of the first five-arm coupler between the left fixed connection element of the first five-arm coupler and the right fixed connection element of the first five-arm coupler and oriented substantially perpendicular to the plane of the cross member of the first five-arm coupler;

with said second five-arm coupler being sized and configured substantially identically to the first five-arm coupler; and with each of the one or more hinged connection elements having a proximate end and a distal end and a hinge mechanism interposed between the proximate and distal ends such that the proximate and distal ends may be varyingly angled in relation to each other;

wherein the outer end of the front fixed connection element of the first five-arm coupler is in connection with a first end of an elongate front connecting member, the outer end of the rear fixed connection element of the first five-arm coupler is in connection with a first end of an elongate first intermediate connecting member, the outer end of the left fixed connection element of the first five-arm coupler is in connection with a first end of an elongate first left connecting member, the outer end of the right fixed connection element of the first five-arm coupler is in connection with a first end of an elongate first right connecting member, the outer end of the vertical fixed connection element of the first five-arm coupler is in connection with a first end of an elongate first vertical connecting member, the outer end of the front fixed connection element of the second five-arm coupler is in connection with a second end of the elongate first intermediate connecting member, the outer end of the rear fixed connection element of the second five-arm coupler is in connection with a first end of an elongate rear connecting member, the outer end of the left fixed connection element of the second five-arm coupler is in connection with a first end of an elongate second left connecting member, the outer end of the right fixed connection element of the second five-arm coupler is in connection with a first end of an elongate second right connecting member, the outer end of the vertical fixed connection element of the second five-arm coupler is in connection with a first end of an elongate second vertical connecting member, and at least one of the one or more hinged connection elements is interposed between one of the elongate front, rear, left, or right connecting members of one of the five-arm couplers and an elongate connecting member, with the proximate end of said hinged connection element being in connection with the outer end of said fixed connection element of said five-arm coupler and the distal end of said hinged connection element being in connection with the first end of said elongate connecting member;

wherein each of the connection hinge elements comprises a first body and a second body, with the first body having a substantially cylindrical shaft and a substantially planar flange extending from an end of said shaft, said flange oriented substantially parallel to a longitudinal axis of said shaft, with said flange having a central aperture, and the second body being sized and configured substantially the same as the first body, with the hinge mechanism of each of the connection hinge elements being a fastener suitably adapted to pass through the central apertures of the flanges of the first and second bodies of each of the connection hinge elements and to hold said first and second bodies in fixed relation to each other once the proximate and distal ends of each of the connection hinge elements have been positioned relative to each other at a desired angle;

wherein one or more of the fixed connection elements of the first five-arm coupler has a single raised projection extending from its inner surface into its hollow interior, such raised projection being substantially rectangular in profile and located set back from the opening of the associated fixed connection element, each of such one or more fixed connection elements being designated a keyed connection element, one or more of the fixed connection elements of the second five-arm coupler has a single raised projection extending from its inner surface into its hollow interior, such raised projection being substantially rectangular in profile and located set back from the opening of the associated fixed connection element, each of such one or more fixed connection elements being designated a keyed connection element, and the shafts of the first and second bodies of each hinged connection element have a pair of slots formed thereon, whereby each of said slots are capable of being aligned with each raised projection in order to cause the hinged connection elements to remain in a predetermined orientation relative to said one or more keyed connection elements when connected thereto.

4. The frame system of claim 3 wherein the fastener of each hinged connection element is a mated bolt and nut pair.

5. A frame system comprising a first five-arm coupler, a second five-arm coupler, a third five-arm coupler, and one or more hinged connection elements, said first five-arm coupler having a left fixed connection element, a right fixed connection element, a front fixed connection element, a rear fixed connection element, a vertical fixed connection element, with each of the fixed connection elements of the first five-arm coupler being substantially elongate and substantially cylindrical and having an outer end and a hollow interior, an opening through the outer end allowing access into the interior, an inner surface facing the interior, and a substantially uniform inside diameter, with the front fixed connection element of the first five-arm coupler is fixedly attached to and oriented substantially collinear with the rear fixed connection element of the first five-arm coupler, forming a substantially cylindrical cross member having openings at opposite ends, the left fixed connection element of the first five-arm coupler is fixedly attached to a midsection of the cross member of the first five-arm coupler and oriented substantially perpendicular to the cross member of the first five-arm coupler, the right fixed connection element of the first five-arm coupler is fixedly attached to the midsection of the cross member of the first five-arm coupler opposite the left fixed connection element of the first five-arm coupler and oriented substantially perpendicular to the cross member of the first five-arm coupler and substantially collinear with the left fixed connection element of the first five-arm coupler, and the vertical fixed connection element of the first five-arm coupler is fixedly attached to the midsection of the cross member of the first five-arm coupler between the left fixed connection element of the first five-arm coupler and the right fixed connection element of the first five-arm coupler and oriented substantially perpendicular to the plane of the cross member of the first five-arm coupler;

with said second five-arm coupler being sized and configured substantially identically to the first five-arm coupler;

with said third five-arm coupler being sized and configured substantially identically to the first five-arm coupler; and with each of the one or more hinged connection elements having a proximate end and a distal end and a hinge mechanism interposed between the proximate and distal ends such that the proximate and distal ends may be varyingly angled in relation to each other;

wherein the outer end of the front fixed connection element of the first five-arm coupler is in connection with a first end of an elongate front connecting member, the outer end of the rear fixed connection element of the first five-arm coupler is in connection with a first end of an elongate first intermediate connecting member, the outer end of the left fixed connection element of the first five-arm coupler is in connection with a first end of an elongate first left connecting member, the outer end of the right fixed connection element of the first five-arm coupler is in connection with a first end of an elongate first right connecting member, the outer end of the vertical fixed connection element of the first five-arm coupler is in connection with a first end of an elongate first vertical connecting member, the outer end of the front fixed connection element of the second five-arm coupler is in connection with a second end of the elongate first intermediate connecting member, the outer end of the rear fixed connection element of the second five-arm coupler is in connection with a first end of an elongate second intermediate connecting member, the outer end of the left fixed connection element of the second five-arm coupler is in connection with a first end of an elongate second left connecting member, the outer end of the right fixed connection element of the second five-arm coupler is in connection with a first end of an elongate second right connecting member, the outer end of the vertical fixed connection element of the second five-arm coupler is in connection with a first end of an elongate second vertical connecting member, the outer end of the front fixed connection element of the third five-arm coupler is in connection with a second end of the elongate second intermediate connecting member, the outer end of the rear fixed connection element of the third five-arm coupler is in connection with a first end of an elongate rear connecting member, the outer end of the left fixed connection element of the third five-arm coupler is in connection with a first end of an elongate third left connecting member, the outer end of the right fixed connection element of the third five-arm coupler is in connection with a first end of an elongate third right connecting member, the outer end of the vertical fixed connection element of the third five-arm coupler is in connection with a first end of an elongate third vertical connecting member, and at least one of the one or more hinged connection elements is interposed between one of the elongate front, rear, left, or right connecting members of one of the five-arm couplers and an elongate connecting member, with the proximate end of said hinged connection element being in connection with the outer end of said fixed connection element of said five-arm coupler and the distal end of said hinged connection element being in connection with the first end of said elongate connecting member;

wherein each of the connection hinge elements comprises a first body and a second body, with the first body having a substantially cylindrical shaft and a substantially planar flange extending from an end of said shaft, said flange oriented substantially parallel to a longitudinal axis of said shaft, with said flange having a central aperture, and the second body being sized and configured substantially the same as the first body, with the hinge mechanism of each of the connection hinge elements being a fastener suitably adapted to pass through the central apertures of the flanges of the first and second bodies of each of the connection hinge elements and to hold said first and second bodies in fixed relation to each other once the proximate and distal ends of each of the connection hinge elements have been positioned relative to each other at a desired angle;

wherein one or more of the fixed connection elements of the first five-arm coupler has a single raised projection extending from its inner surface into its hollow interior, such raised projection being substantially rectangular in profile and located set back from the opening of the associated fixed connection element, each of such one or more fixed connection elements being designated a keyed connection element, one or more of the fixed connection elements of the second five-arm coupler has a single raised projection extending from its inner surface into its hollow interior, such raised projection being substantially rectangular in profile and located set back from the opening of the associated fixed connection element, each of such one or more fixed connection elements being designated a keyed connection element, one or more of the fixed connection elements of the third five-arm coupler has a single raised projection extending from its inner surface into its hollow interior, such raised projection being substantially rectangular in profile and located set back from the opening of the associated fixed connection element, each of such one or more fixed connection elements being designated a keyed connection element, and the shafts of the first and second bodies of each hinged connection element have a pair of slots formed thereon, whereby each of said slots are capable of being aligned with each raised projection in order to cause the hinged connection elements to remain in a predetermined orientation relative to said one or more keyed connection elements when connected thereto.

6. The frame system of claim 5 wherein the fastener of each hinged connection element is a mated bolt and nut pair.

* * * * *